US005209536A

United States Patent [19]

Rogers, Sr. deceased et al.

[11] Patent Number: 5,209,536

[45] Date of Patent: May 11, 1993

[54] HYDRAULIC GRAPPLE CLAMP

[76] Inventors: Albert B. Rogers, Sr. deceased, late of Saco, Me.; legal representative Rogers, 495 Buxton Rd., Saco, Me. 04072

[21] Appl. No.: 829,720

[22] Filed: Feb. 3, 1992

[51] Int. Cl.[5] ..... B66C 1/44

[52] U.S. Cl. ..... 294/88; 294/104

[58] Field of Search ..... 294/88, 104, 902, 67.31; 901/37

[56] References Cited

U.S. PATENT DOCUMENTS

| | | | |
|---|---|---|---|
| 2,370,528 | 2/1945 | Fontaine | 294/88 |
| 2,596,895 | 5/1952 | Frischmann | 294/88 X |
| 2,782,067 | 2/1957 | La Bonte et al. | 294/104 X |
| 3,614,151 | 10/1971 | Shadle | 294/104 |
| 3,817,567 | 6/1974 | Lull | 294/88 |
| 3,964,778 | 6/1976 | Jouppi | 294/88 |
| 4,090,628 | 5/1978 | Sinclair | 294/88 X |
| 4,266,819 | 5/1981 | Pemberton | 294/88 |

FOREIGN PATENT DOCUMENTS

| | | | |
|---|---|---|---|
| 65693 | 9/1972 | Poland | 294/88 |

*Primary Examiner*—Russell D. Stormer
*Assistant Examiner*—Dean J. Kramer
*Attorney, Agent, or Firm*—William Nitkin

[57] ABSTRACT

An hydraulically powered grapple clamp having an L-shaped frame member including a crossbeam and a side leg extending from one end of the crossbeam and a movable arm extending from the other end of the crossbeam with a hydraulic ram affixed at the junction of the crossbeam and side leg extending over to the movable arm adapted to move the arm so as to open and close the grapple clamp on an object.

4 Claims, 3 Drawing Sheets

HYDRAULIC GRAPPLE CLAMP

BACKGROUND OF THE INVENTION

1. Field of the Invention

The device of this invention resides in the area of lifting devices and more particularly relates to a device lifted by a host machine, such device hydraulically operated to grasp and lift objects.

2. Description of the Prior Art

Grapple devices utilized to manipulate construction materials are known in the prior art such as disclosed in U.S. Pat. No. 3,964,778 to Jouppi for a Grapple which patent discloses a grapple having a pair of stationary jaws and a pair of movable jaws with a hydraulic ram moving a pivoted arm where the ram is connected to the upper end of the stationary jaws and to the movable jaws to move the jaws relative to each other. The jaws grip upon the expansion or outward movement of the hydraulic ram's piston. Also notable in the prior art is U.S. Pat. No. 2,596,895 to Frischmann for an Article Gripping System for Lift Trucks which discloses a grapple having a fixed arm and a pivoted arm with the jaws gripping an object upon the expansion or outward movement of the hydraulic ram's piston. These patents illustrate large and complex structures.

SUMMARY OF THE INVENTION

It is an object of the hydraulic grapple clamp of this invention to provide a material-lifting device which has improved operational features over the prior art making it easier to use and easier to carefully grasp, lift and precisely manipulate objects such as curbing stones, rocks, paving stones, transit pipes, granite slabs and a wide range of other types of construction materials. The device of this invention is especially useful for the lifting of large construction materials. Since the device of this invention is small, compact and highly portable, it can be handled by one worker, the device being suspended from a host machine by a cable or chain as will be described further below. The operator also controls hydraulic pressure in two pressure lines running to the device which open and close the clamps of the invention.

The invention includes a clamp attached to an L-shaped frame member to which is affixed one end of a hydraulic ram and a movable arm with a clamp, such arm also affixed to the L-shaped frame with such movable arm affixed to the other end of the hydraulic ram. The movable arm is moved to an open and closed position by the forward and rearward movement of the piston within the hydraulic ram. The device can manipulate heavy items, for example, by lifting them up, standing them upright, and turning them over. The device utilizes a reverse ram action to grasp objects making it simpler and easier to use than the more complex prior art devices.

In general the device has a fixed L-shaped frame having a crossbeam and an extending side leg at a right angle to the crossbeam with the end of the side leg having an adjustably positioned clamp member. At the other end of the crossbeam is a pivot aperture to which is pivotally attached a movable arm extending down to a second clamp which second clamp is disposed generally parallel to the adjustably positioned clamp on the opposite side leg of the fixed L-shaped frame. A "strong back" reinforcing beam is provided welded integrally on the rear of the crossbeam of the L-shaped frame which extends around to the front of the crossbeam to form a hinge base upon which a hydraulic ram is movably hinged with a piston therein with an attached arm that can be moved inward and outward upon the receipt of hydraulic pressure from two hydraulic lines, one disposed on each side of the piston within the hydraulic ram. The shaft from the piston is pivotally attached on a pivot attachment member located on the movable arm. The other end of the ram is hingeably attached to the hinge base at the upper corner of the fixed L-shaped frame. By action of hydraulic pressure through the hydraulic lines, the movable arm can be moved, pivoting on its arm pivot either away from or toward the adjustable clamp. Clamp members of different shapes can be used and such clamp members can have limited pivotal movement of their own to accommodate any irregular shaped objects to be lifted by the device of this invention.

The device of this invention can be suspended from a cable or chain attached to a pivoting loop at a suspension point located offset on the crossbeam of the L-shaped frame so that the structure is generally balanced when lifted by the lifting cable. The device can be easily maneuvered by one operator, allowing a portion of it to touch the object on the ground and when the hydraulic pressure enters the hydraulic ram to move the piston toward the hydraulic ram's attachment point to the L-frame, the movable arm moves inward, grasping what is desired to be lifted. This inward pulling of the hydraulic ram or reverse pressure on the object to be lifted allows for the device of this invention to be of very simple construction.

DESCRIPTION OF THE PREFERRED EMBODIMENT(S)

Figure 1:
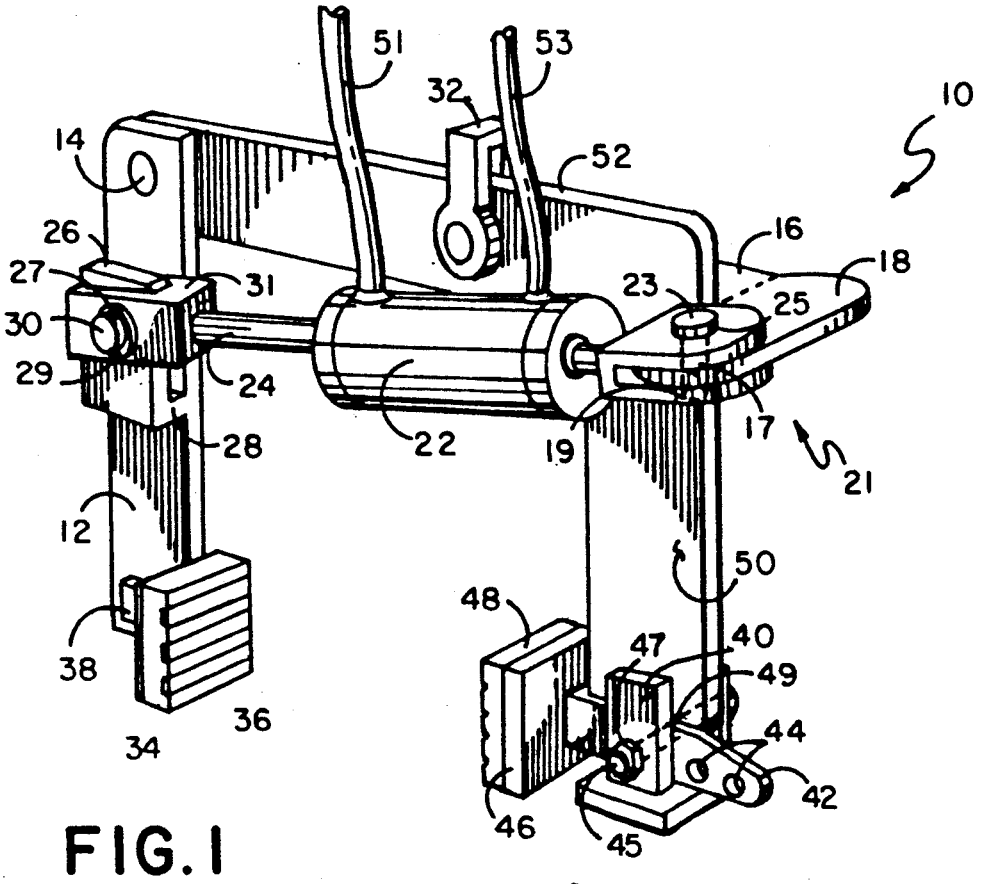
FIG. 1 illustrates a front perspective view of the hydraulic grapple clamp of this invention.

FIG. 1 illustrates a front view of the hydraulic grapple clamp of this invention wherein fixed L-shaped frame 10 is seen with its crossbeam 52 and junction to downwardly extending side leg 50. At the bottom of side leg 50 is adjustable clamp 46 which can have a rubber-like pad 48 on its face. Adjustable clamp 46 can pivot somewhat on pivot pin 45 passed through one of the mounting apertures 44 on support member 42 and aperture 47 in first clamp-mounting member 40. Adjustable clamp 46 is variably positioned away from the bottom of side leg 50. Second clamp mount member 41 has an aperture 43 formed therein to receive pivot pin 45 after it is entered through aperture 47 and through the selected of apertures 44 and into aperture 43 when adjustable clamp 46 is positioned at the desired distance from side leg 50. Support member 42 passes within slot 49 between first and second clamp mount members 40 and 41. Clamp 46 can be adjusted inward or outward from side leg 50 by putting pivot pin 45 through a selected one of mounting apertures 44 along the length of its support member 42.

In a location to balance the device on crossbeam 52 of fixed L-shaped frame 10 is suspension hook 32 which is pivotally attached to frame 10 and can be attached by a chain or cable to a host lifting device not shown. The location of suspension hook 32 is somewhat off center to balance the device, it being approximately 14.5 inches from pivot pin 14 while crossbeam 52 is approximately 24 inches long. This offset not only helps balance the mass of the device and allows it to lift objects properly, but also facilitates pitching the movable arm down beneath the object to be lifted.

Figure 2:
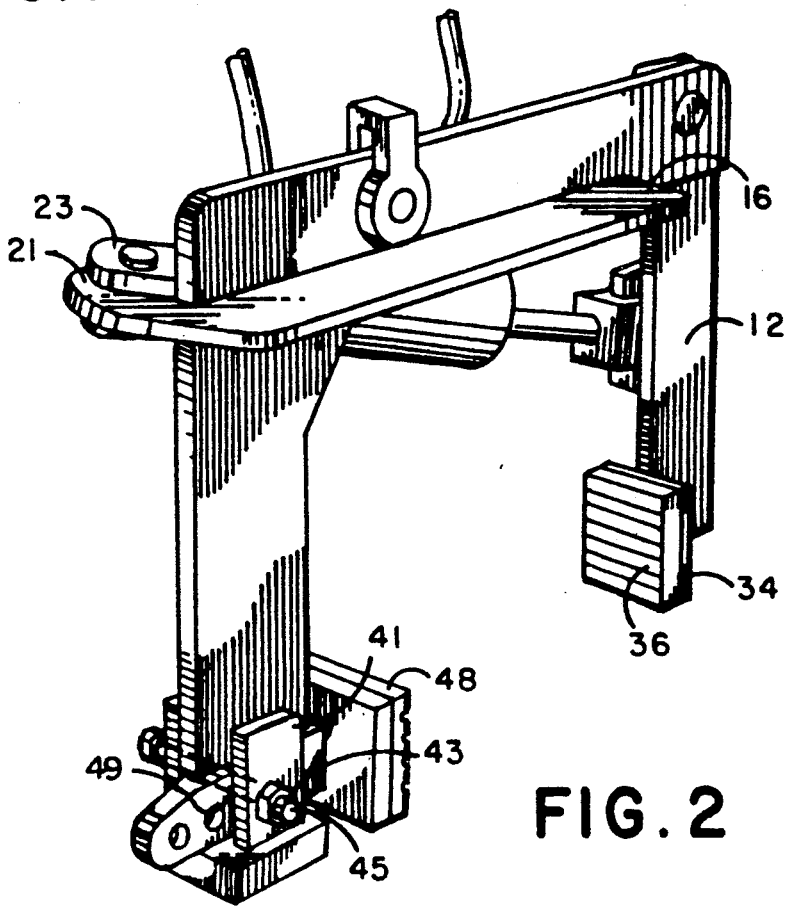
FIG. 2 illustrates a rear perspective view of the device of this invention.

Movable arm 12 is attached by arm pivot pin 14 to the end of crossbeam 52. Movable arm 12 can move back and forth away and toward side leg 50. Movable arm 12 has at its bottom fixed clamp 34 which can also have rubber pad 36 on its face. Fixed clamp 34 can have a pivot pin 38 which holds it in position to movable arm 12, giving fixed clamp 34 a limited vertical pivotal range to help it accommodate the shape of various objects that are to be lifted. Extending from a point generally lower than the midpoint on movable arm 12 is leg member 28 which extends outward from movable arm 12. The leg member then extends upward to form piston attachment member 26 which has aperture 29 therein to receive piston shaft attachment pin 30 therethrough. Piston shaft 24 terminates in a U-shaped yoke attachment member 31 with pair of apertures 27 therein so that piston attachment pin 30 passes through pair of apertures 27 in U-shaped yoke attachment member 31 such that U-shaped yoke attachment member 31 pivots upon pivot attachment member 26. Yoke attachment member 31 is attached by piston shaft 24 to the piston within hydraulic ram 22. The piston is not shown but is well known in the art to pass back and forth within the hydraulic ram depending upon how hydraulic fluid is provided to the hydraulic ram through hydraulic lines 51 and 53. If pressure comes from hydraulic line 51, the piston in FIG. 1 will move to the right, pulling piston shaft 24 toward side leg 50, thereby moving movable arm 12 toward side leg 50, compressing and holding whatever is between fixed clamp 34 and adjustable clamp 46. As long as hydraulic pressure is maintained within the hydraulic ram hydraulic line 51, the clamps remain tightly closed against the object being held, securely holding such object. Should the operator decide to release what is being held or to otherwise move movable arm 12 away from side leg 50, hydraulic pressure can be provided through hydraulic line 53 to the other side of the piston in hydraulic ram 22 thereby forcing piston shaft 24 away from side leg 50 and moving movable arm 12 and its fixed clamp 34 away from adjustable clamp 46. At the other end of the hydraulic ram is second attachment member 21 which is a yoke extending over both sides of hinge base 19. Hinge pin 23 passes through aperture 17 in hinge base 19 and through apertures 25 in second attachment member 21 to pivotally attach the other end of the hydraulic ram to hinge base 19 at a downward angle of approximately 11 degrees from crossbeam 52. Hinge base 19 is disposed at such 11 degree angle where it attaches to second attachment member 21 and also as it extends around frame 10. Hinge pin 23 can fit somewhat loosely in apertures 25 in second attachment member 21 to provide some play that is helpful as movable arm 12 is operated. Also hinge base 19 provides a convenient support if the ram is to be serviced or replaced, for example, when yoke attachment member 31 is released from movable arm 12, the ram swings outward for easy access. Hinge base 19 protrudes from the front of L-shaped frame 10 and then extends around the end of the frame to strong back 16 of which hinge base 19 is an integral part. Strong back 16 extends horizontally and is integrally welded along the rear of crossbeam 52 of L-shaped frame 10 as seen in FIG. 2. Strong back 16 extending to provide a pivot point for attachment of the upper end of the hydraulic ram. The pivots existing at both ends of the hydraulic ram allow for movement of the hydraulic ram to accommodate the backward and forward movement of the movable arm toward and away from side leg 50, thereby easily opening and closing fixed clamp 34 from adjustable clamp 46.

Figure 3:
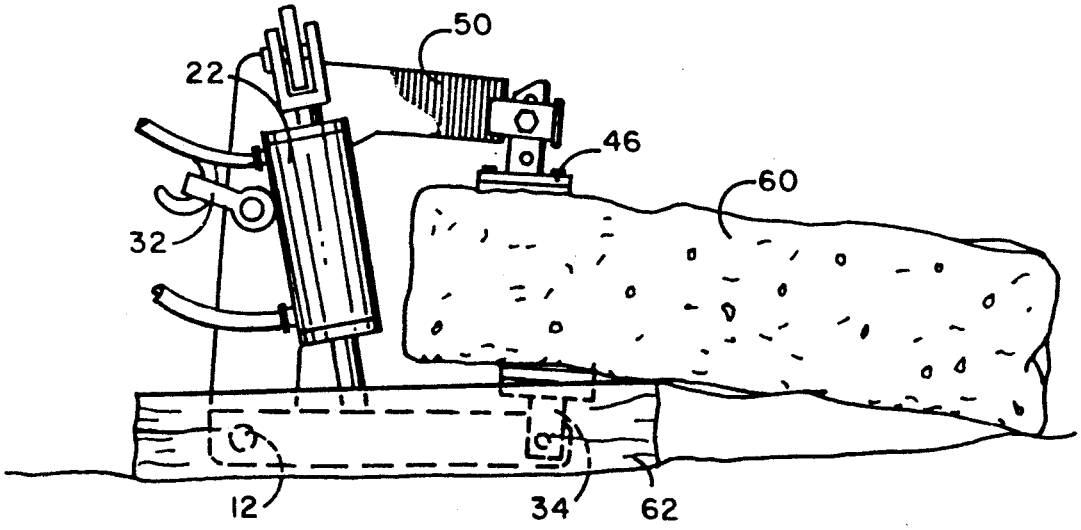
FIG. 3 illustrates a front view of the device of this invention with the movable arm extending under an object resting on dunnage to keep a portion of it clear of the ground.

FIG. 3 illustrates the device of this invention about to lift granite slab 60 which is shown resting on a piece of dunnage 62, the purpose of which is to keep one portion of granite slab 60 above the ground. To lift slab 60, the operator maneuvers the device so that movable arm 12 slides underneath slab 60 and then upon the reverse action of hydraulic ram 22, movable arm 12 is moved toward side leg 50 and the device then closes its fixed clamp 34 toward adjustable clamp 46 and tightly grasps granite slab 60.

Figure 4:
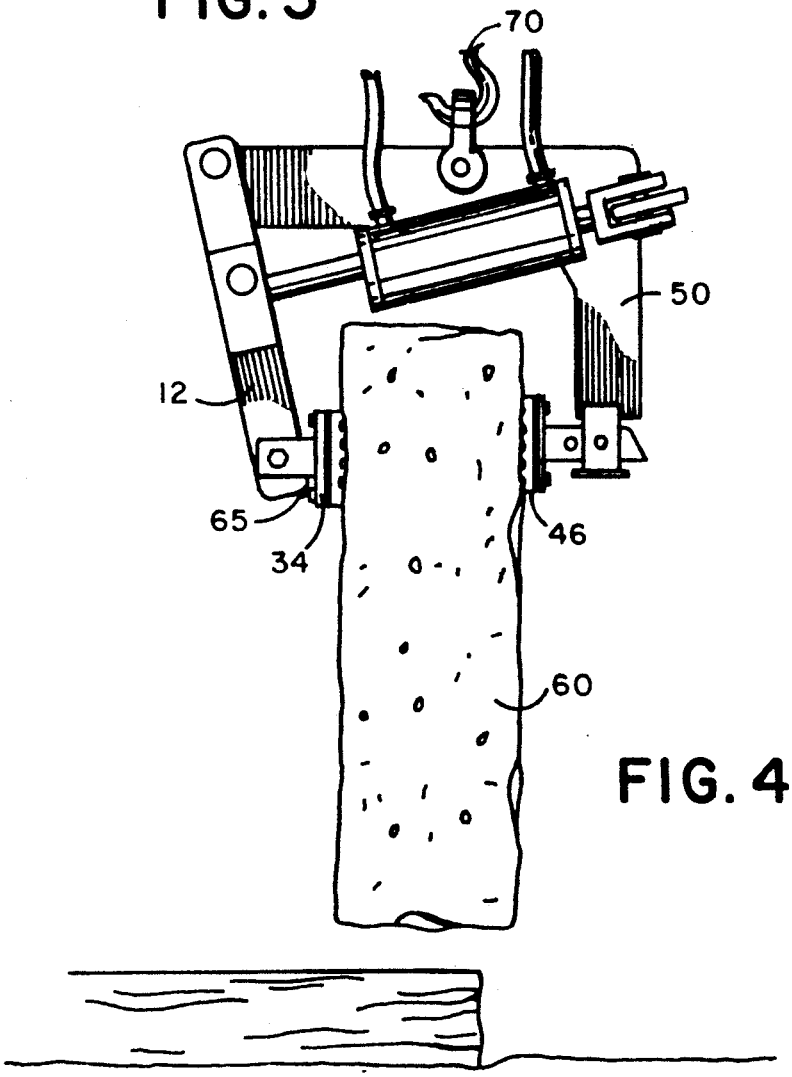
FIG. 4 illustrates the device of this invention lifting the object seen in FIG. 3.

In FIG. 4 one can see hook 70 from the host device lifting the device of this invention upwards thereby also lifting slab 60 completely off the ground which slab can be placed very carefully and precisely in a new position as desired by the operator. The limited pivotal range of movement of fixed clamp 34, seen no longer parallel to arm 12, allows for clamp 34 to align with the side of slab 60 to better hold it.

Figure 5:
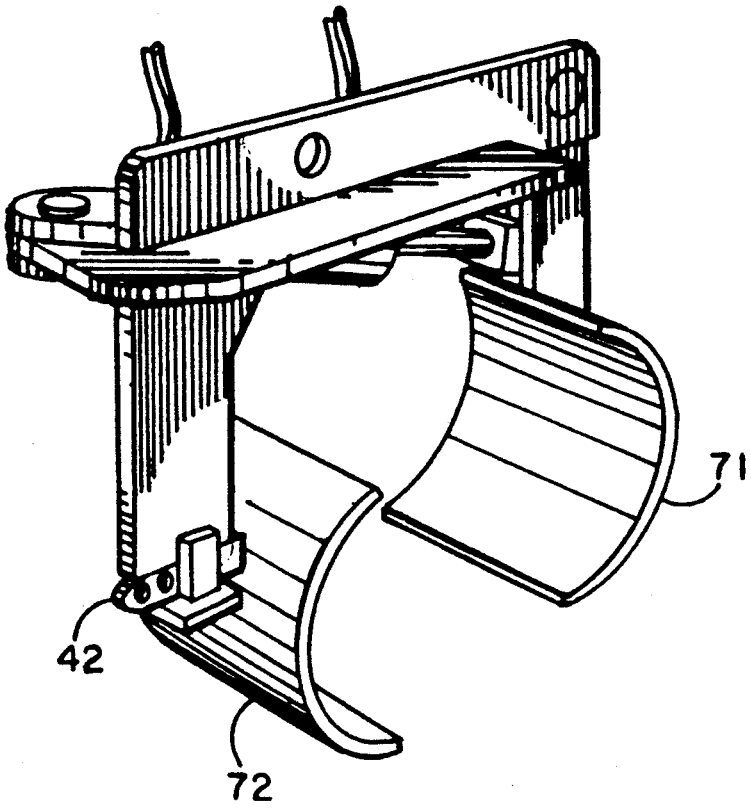
FIG. 5 illustrates the device of this invention utilizing adjustable pipe clamps in place of the pad-like clamp members shown in prior views.

FIG. 5 illustrates a rear view of the structure of this invention utilizing other clamp members, being adjustable pipe clamp members 72 and fixed pipe clamp member 71. These clamps are designed to lift pipe-like materials having diameters of 6 inches to 24 inches. These adjustable pipe clamps, although positioned horizontally in FIG. 5, can also be positioned vertically for use in moving upright cylinders such as barrels and other objects from place to place. These clamps also can have rubber pads attached to their inner faces.

Because of the simple action of movable arm 12 toward side leg 50 which allows for the grasping of objects as thin as 1 inch in width or as wide as 23 ¼ inches, the device of this invention can be used on many types of host machinery from small Bobcat bucket loaders up to large excavating machines. The hydraulic ram can have a 3-inch bore with an 8-inch stroke and move movable arm 12 back and forth the full distance. A ram with a longer stroke can extend the opening range of movable arm 12 several inches, if desired. Using this device for the installation of curbstones, for example, eliminates the need for chains and slings which can damage such curbstones because the device of this invention can position the curbstones very accurately into their final desired positions. Besides lifting a wide range of construction materials, the device of this invention can lift heavy equipment tires or plow blades during their attachment or detachment without the need for separate chain attachments. The device's precise handling capability allows it to lift and stand materials upright or turn then over. Another major advantage to the device of this invention is its portability compared to the large, heavy and complicated structures of the prior art as it can be easily and quickly mounted by a chain or cable to a host machine using the simple hydraulic attachments that are already provided on such equipment.

In a preferred embodiment the device can be built generally of $\frac{3}{4}$-$\frac{7}{8}$ inch steel stock or equivalent strong material, and L-shaped fixed frame 10 can have crossbeam 52 extend approximately 24 inches with strong back 16 welded onto frame 10 provided at a length of approximately 22 inches toward the junction with the side leg where a portion of strong back 16 extends 2.5 inches beyond crossbeam 52 and rises at an 11 degree angle, as seen in FIG. 2, at which point strong back 16 extends around also integrally welded to the end of side leg 50 and is attached at such downward angle to second attachment member 21 by hinge pin 23 to hydraulic ram 22. Side leg 50 can extend approximately 14½ inches from the top of the fixed frame to its base and can have adjustable clamp 46 mounted thereto such that it can be adjusted inward or outward by pushing pivot pin 45 through a selected mounting aperture 44. By utilizing support member 42, the operator can move adjustable clamp 46 significantly toward fixed clamp 34 of movable arm 12. Movable arm 12 can be approximately 20 inches in length and have at its base a fixed clamp which is pivotally retained by pivot member 38 such that it pivots vertically. The bottom of movable arm 12 is somewhat curved within the area of movement of fixed clamp 34 so that fixed clamp 34 can move somewhat up and down in relation to movable arm 12 when grasping structures without striking the corner of movable arm 12. A welded-on stop member 65 can be used to limit the range of motion of fixed clamp 34. By moving the piston within the hydraulic ram and moving fixed clamp 34 toward adjustable clamp 46 when in its most advanced position, very small objects can be securely held between clamp members 34 and 46. Piston attachment member 26 is positioned approximately 8 inches from pivot point 14 on movable arm 12 which is 20 inches long. This off-center location on movable arm 12 is critical to providing the desired range of motion.

Although the present invention has been described with reference to particular embodiments, it will be apparent to those skilled in the art that variations and modifications can be substituted therefor without departing from the principles and spirit of the invention.

I claim:

1. A hydraulic grapple clamp to be lifted by a host machine, comprising:

an L-shaped frame having a crossbeam, said crossbeam having a first and second end and a front and rear, and a lower leg extending at a right angle from the second end of said crossbeam at the junction thereof, said crossbeam having defined thereon attachment means to be affixed to said host machine, said lower leg having a base with mounting means thereon;

an adjustable clamp member adjustably mounted to the mounting means at the base of said lower leg;

a movable arm having a top, a central portion and a bottom;

means to rotatably attach the top of said movable arm to the first end of said crossbeam of said frame;

an upwardly and downwardly movable clamp member disposed at the bottom of said movable arm, said movable clamp member facing said adjustable clamp member;

a hinge base disposed at the junction of said crossbeam and said lower leg, said hinge base extending around from the front to the rear of said lower leg, said hinge base disposed at an angle of approximately 11 degrees to said crossbeam;

a hydraulic ram having a first and second end and a piston therein, the first end of said hydraulic ram being pivotally attached to said movable arm; the second end of said hydraulic ram affixed to said hinge base; and a strong back welded integrally to and extending along a portion of the rear of said crossbeam interconnected to the portion of said hinge base extending around from the front of said L-shaped frame, said device operable by hydraulic action with a first hydraulic line extending to one side of a piston within said hydraulic ram and a second hydraulic line extending to the other side of said piston, each hydraulic line disposed on an opposite side of said piston within said ram such that said movable arm can be moved back and forth by the operation of said hydraulic ram.

2. The clamp of claim 1 wherein the action moving said movable arm toward said lower leg bringing said movable clamp toward said adjustable clamp is from the reverse action of said ram directly pulling on said movable arm.

3. The clamp of claim 2 wherein said first end of said hydraulic ram is attached off-center on said movable arm at a position closer to said crossbeam than to said movable clamp member.

4. The clamp of claim 3 wherein said attachment means on said crossbeam is located off-center at a position closer to said hinge base than to said movable arm to balance said clamp evenly when it is lifted by said host machine.

* * * * *